US005360940A

United States Patent [19]

Hays

[11] Patent Number: 5,360,940

[45] Date of Patent: Nov. 1, 1994

[54] SCAVENGELESS TWO COMPONENT DEVELOPMENT WITH AN ELECTRODED DEVELOPMENT ROLL

[75] Inventor: Dan A. Hays, Fairport, N.Y.

[73] Assignee: Xerox Corporation, Stamford, Conn.

[21] Appl. No.: 91,858

[22] Filed: Jul. 14, 1993

[51] Int. Cl.[5] ..... G03G 15/09

[52] U.S. Cl. ..... 118/654; 118/651; 355/247; 355/261

[58] Field of Search ..... 355/251, 259, 261–265, 355/247, 249; 118/647–651, 656–658, 654

[56] References Cited

U.S. PATENT DOCUMENTS

| | | | |
|---|---|---|---|
| 3,257,224 | 6/1966 | Jöns et al. | 430/119 |
| 3,996,892 | 12/1976 | Parker et al. | 118/658 |
| 4,289,837 | 9/1981 | Gundlach | 118/651 X |
| 4,515,106 | 5/1985 | Kohyama | 118/651 |
| 4,564,285 | 1/1986 | Yasuda et al. . | |
| 4,647,179 | 3/1987 | Schmidlin . | |
| 4,841,332 | 6/1989 | Haneda et al. | 355/251 |
| 5,031,570 | 7/1991 | Hays et al. | 118/654 |
| 5,054,419 | 10/1991 | Itaya et al. | 118/657 |
| 5,061,966 | 10/1991 | Haneda et al. | 355/297 |
| 5,107,304 | 4/1992 | Haneda et al. | 355/296 |
| 5,162,821 | 11/1992 | Fukuchi et al. | 346/157 |
| 5,172,170 | 12/1992 | Hays et al. | 355/259 |
| 5,289,240 | 2/1994 | Wayman | 355/259 |

FOREIGN PATENT DOCUMENTS

| | | | |
|---|---|---|---|
| 0181372 | 10/1984 | Japan | 355/265 |
| 0273563 | 12/1986 | Japan . | |

OTHER PUBLICATIONS

Konica 9028 Service Manual pp. 2–3, 2–14.

*Primary Examiner*—Robert B. Beatty
*Attorney, Agent, or Firm*—Robert Hutter

[57] ABSTRACT

A two-component development unit for an electrophotographic printer includes a rotatable donor roll having a plurality of longitudinal electrodes along its circumference. A magnetic structure within the donor roll permits two-component developer to be advanced to a development zone. Adjacent electrodes on the donor roll are AC biased in opposite phases so as create a powder cloud of toner from the developer in the development zone. The magnetic structure is arranged to provide pole effects substantially immediately downstream and upstream of the development zone in the direction of motion of the donor roll.

10 Claims, 4 Drawing Sheets

SCAVENGELESS TWO COMPONENT DEVELOPMENT WITH AN ELECTRODED DEVELOPMENT ROLL

This application incorporates by reference U.S. Pat. No. 5,172,170, assigned to the assignee of this application. Cross-reference is also made to application Ser. No. 08/063,817, filed May 20, 1993, entitled "Improved Scavengeless Development with Electroded Development Roll," now U.S. Pat. No. 5,289,240 and application Ser. No. 08/037,700, filed Mar. 29, 1993, entitled "Development System Coatings," now U.S. Pat. No. 5,300,339.

This invention relates generally to an electrophotographic printing machine, and more particularly concerns a two-component scavengeless development system having a donor roll with electrodes integral therewith.

Generally, the process of electrophotographic printing includes charging a photoconductive member, or photoreceptor, to a substantially uniform potential. The charged portion of the photoconductive member is exposed to a light image of an original document being reproduced. This records an electrostatic latent image on the photoconductive member. After the electrostatic latent image is recorded on the photoconductive member, the latent image is developed by bringing a developer material into contact therewith. Two-component and single-component developer materials are commonly used. A typical two-component developer material comprises magnetic carrier particles, also known as "carrier beads," having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

Recently there has been interest in a type of development of the electrostatic latent image in which multiple images, e.g., of different colors, may be successively superimposed on the photoreceptor, so as to form a full-color image with different color toners. A significant problem to be avoided with multiple development steps is that a succeeding development step may interfere with, or "scavenge," toner which has been placed on the photoreceptor in a previous developing step. There is thus a need for development techniques which are "scavengeless." One type of scavengeless development system uses a donor roll for transporting charged toner to the development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development unit employs a magnetic brush developer roller for transporting carrier having toner particles adhering triboelectrically thereto. Toner is attracted to the donor roll from the magnetic roll. The electrically biased electrode wires detach the toner from the donor roll, forming a toner powder cloud in the development zone. The latent image attracts the toner particles thereto from the toner powder cloud. In this way, the latent image recorded on the photoconductive member is developed with toner particles.

A key variation to the powder-cloud-creation techniques which are the essence of scavengeless development is to provide electrodes, not spaced from the donor roll, but rather embedded within the donor roll. U.S. Pat. No. 5,172,170, assigned to the assignee of the present application, discloses a scavengeless development unit in which a set of longitudinally-disposed electrodes are mounted on a rotating donor roll. A contact brush is used as a commutator to energize those electrodes in the development zone. When the electrodes are energized, AC electric fields are formed between adjacent electrodes which causes toner near the electrodes to jump off the donor roll and form a powder cloud which may be used to develop the latent image.

U.S. Pat. No. 3,257,224 discloses an apparatus for developing electrostatic images in which a developer roller transports both toner and a magnetic carrier. The roll is made up of rotor plates having windings to which current is supplied intermittently, and an outer cover of an insulating plastic material. The purpose of the electromagnetic windings within the roller is to attract developer material from a sump to the surface of the roller; the electromagnetism is cut off only to clean the roller and recycle the developer, after the given portion of the surface exits the development zone.

The Konica Corporation model no. 9028 is a currently-available product in which the development unit comprises a donor roll having disposed therewithin a magnetic structure for picking up two-component magnetic developer from a supply and conveying it to the development zone. The toner is then caused to adhere to the photoreceptor by providing an AC bias to the entire outer sleeve of the donor roll relative to the photoreceptor itself, in a manner which is familiarly known in the art as "AC jumping" development. Several Konica patents which disclose this general technique and variations thereof are U.S. Pat. No. 5,054,419; U.S. Pat. No. 5,061,966; U.S. Pat. No. 5,107,304; and U.S. Pat No. 5,162,821. In some of these patents there is disclosed an arrangement whereby the magnetic structure rotates within the donor roll sleeve, in the opposite direction as the donor roll sleeve, to pick up developer.

In accordance with one aspect of the present invention, there is provided an apparatus for developing a latent image recorded on a surface. A housing defines a chamber storing a supply of magnetically-attractable developer therein. A moving donor roll spaced from the surface transports developer from the chamber of the housing to a development zone adjacent the surface. A magnetic structure attracts developer to the donor roll. A plurality of selectively-actuable electrodes disposed around the circumference of the donor roll create a powder-cloud of toner outside the donor roll covered with developer.

Other features of the present invention will become apparent as the following description precedes and upon reference to the drawings, in which.

Figure 1:
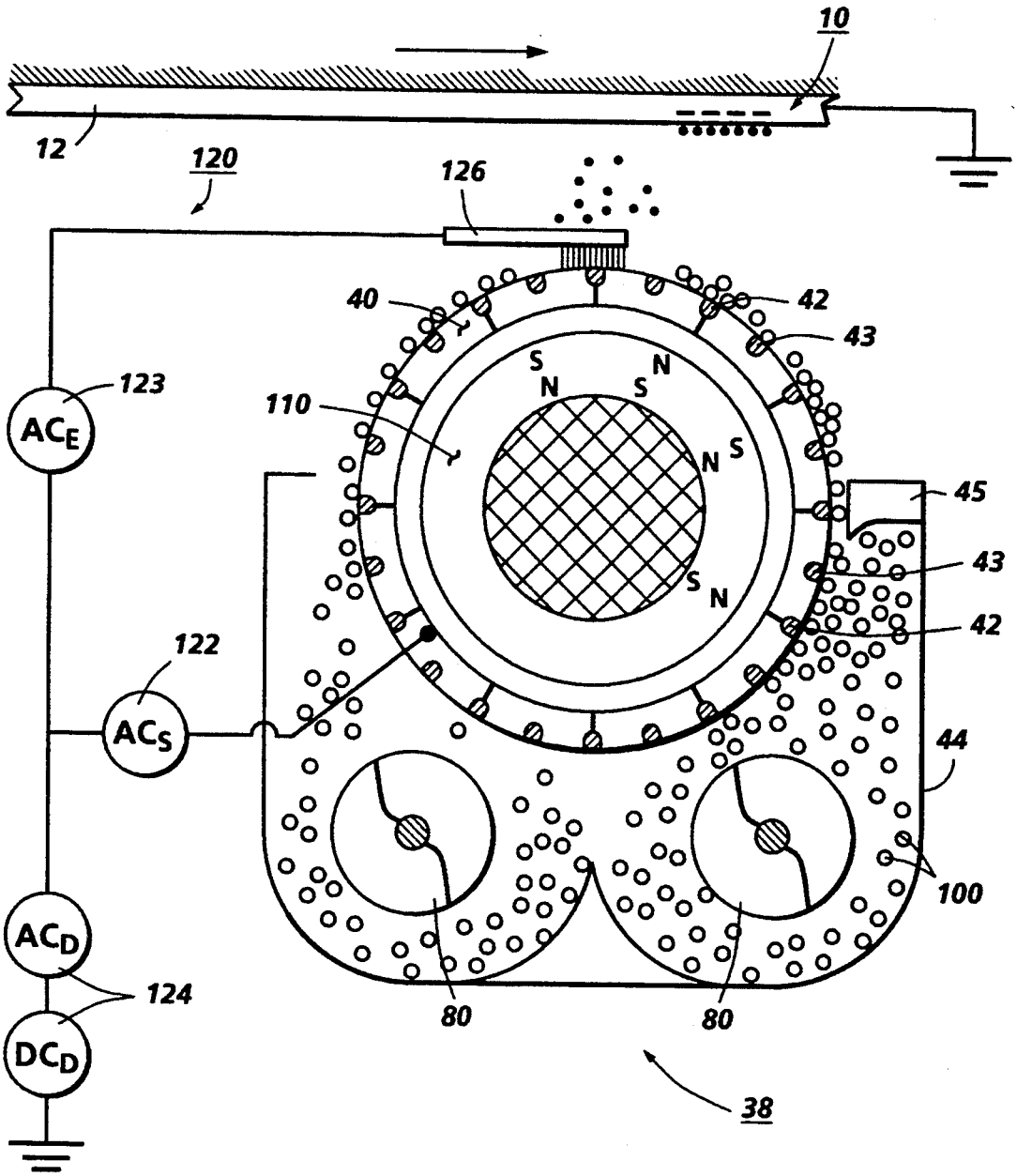
FIG. 1 is a schematic elevational view showing the development apparatus according to one embodiment of the invention.
Figure 3A:
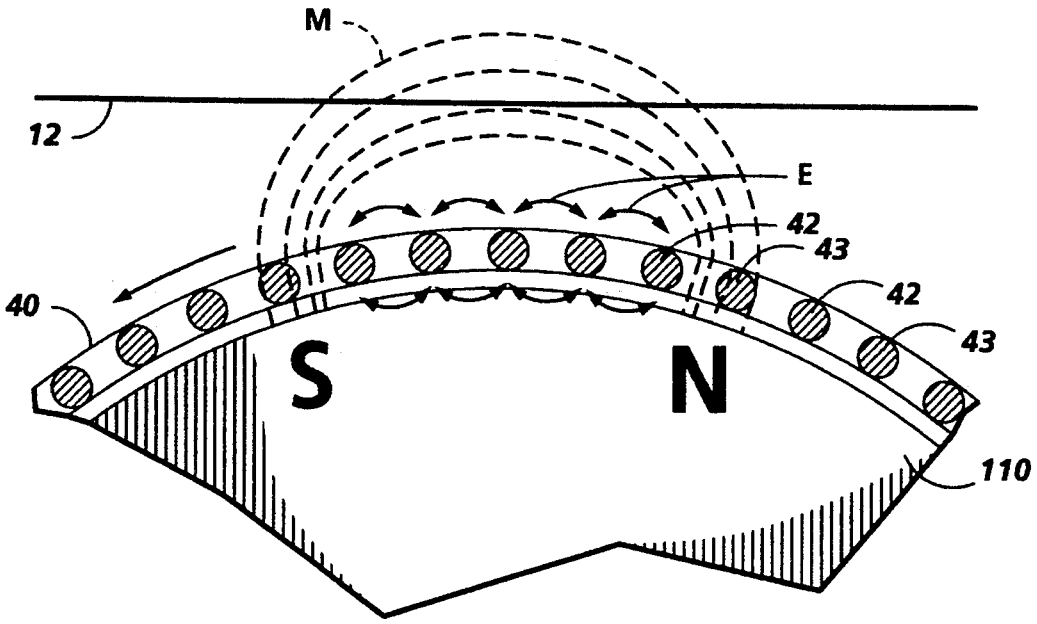
Figure 3B:
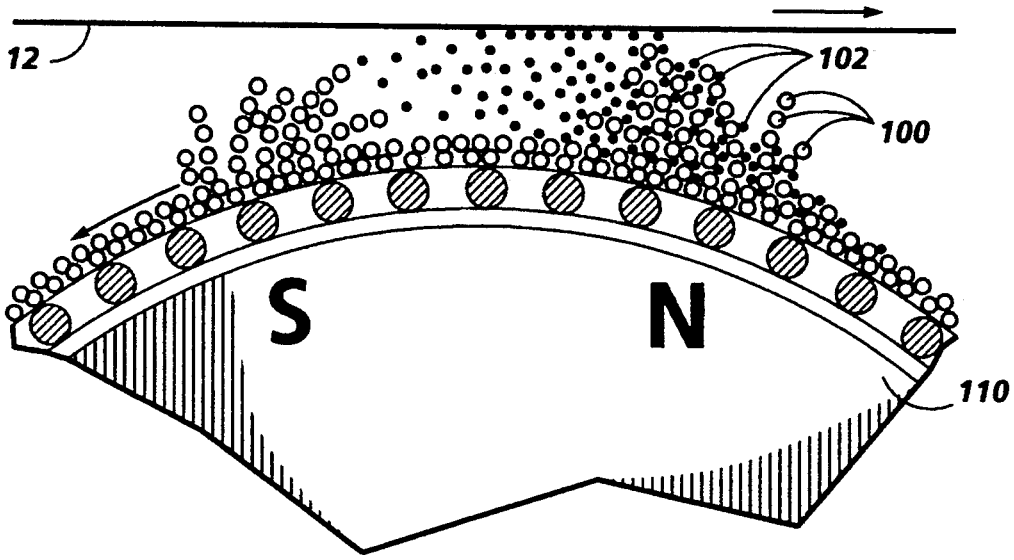
Figure 4:
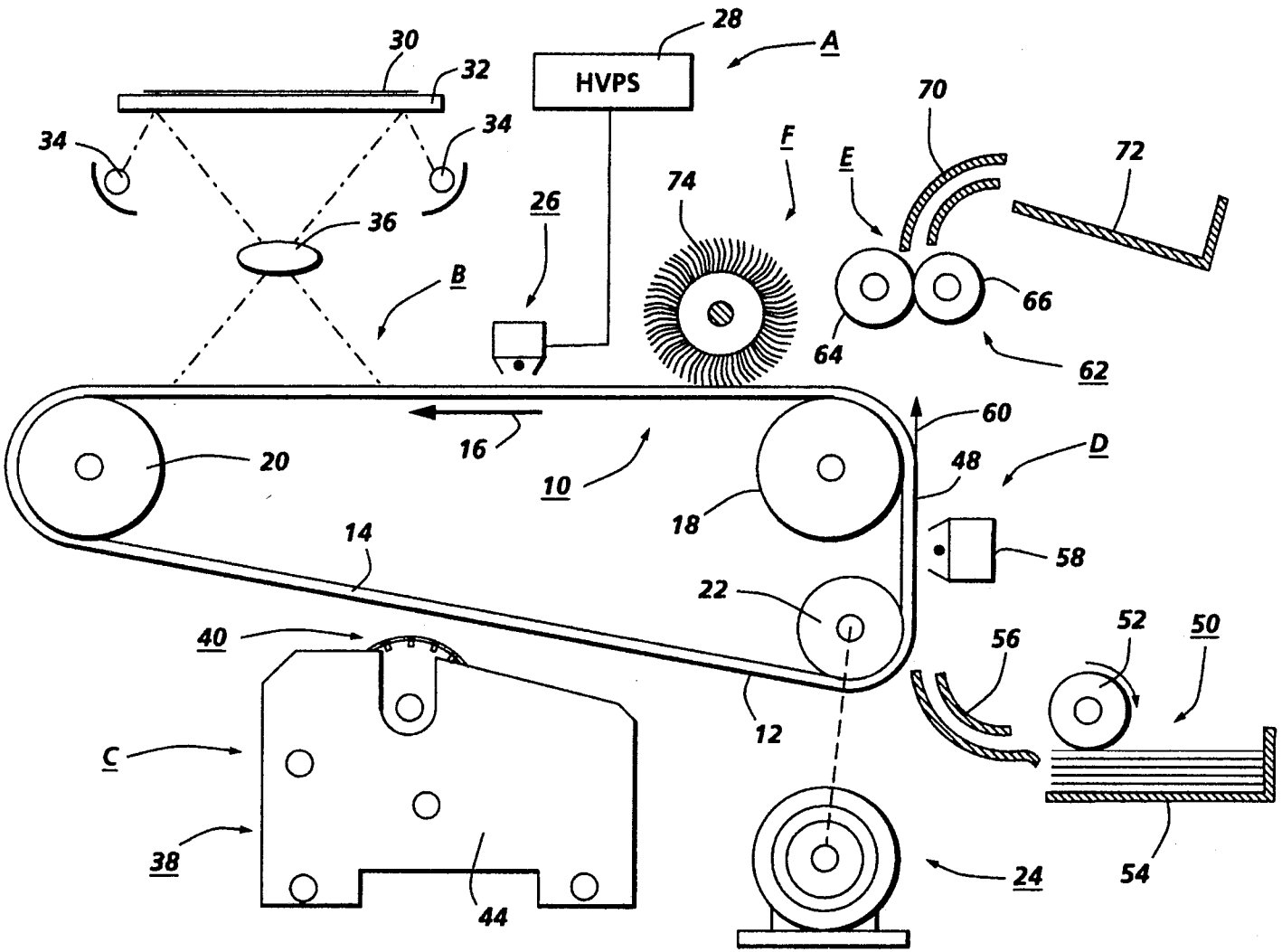

FIG. 3A is a detailed sectional view showing the configuration of magnetic and electrical fields within the development zone in the development apparatus, and FIG. 3B is a detailed sectional view showing the behavior of carrier and toner particles within the development zone in the development apparatus according to one embodiment of the invention; and FIG. 4 is a schematic elevational view of an illustrative electrophotographic printing machine incorporating the FIG. 1 development apparatus therein.

Referring initially to FIG. 4, there is shown an illustrative electrophotographic printing machine incorporating the development apparatus of the present invention therein. The electrophotographic printing machine employs a belt 10 having a photoconductive surface 12 deposited on an electrically grounded conductive substrate 14. One skilled in the art will appreciate that any suitable photoconductive material may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a suitable pair of springs (not shown) resiliently urging tensioning roller 20 against belt 10 with the desired spring force. Roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30. Alternatively, a raster output scanner may be used in lieu of the light lens system previously described to layout an image in a series of horizontal scan lines with each line having a specified number of pixels per inch. Typically, a raster output scanner includes a laser with a rotating polygon mirror block and a modulator.

After the electrostatic latent image has been recorded on photoconductive surface 12, belt 10 advances the latent image to development station C. At development station C, a developer unit, indicated generally by the reference numeral 38 develops the latent image recorded on the photoconductive surface. Preferably, developer unit 38 includes a donor roller 40 having a plurality of electrodes or electrical conductors embedded therein and integral therewith, as will described in detail below. Donor roller 40 is mounted, at least partially, in the chamber of developer housing 44. The chamber in developer housing 44 stores a supply of developer material. The developer material is typically a two-component developer material of at least carrier particles having toner particles adhering triboelectrically thereto. Developer unit 38 will be discussed hereinafter, in greater detail, with reference to FIG. 1.

With continued reference to FIG. 4, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and back-up roller 66. Sheet 48 passes between fuser roller 64 and backup roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

FIG. 1 is a sectional elevational view showing the developer station 38, according to the present invention, in detail. The developer station 38 includes, rotatably mounted therein, a donor roll 40 which is caused to rotate by a motor (not shown) in the direction shown by the arrow. A portion of the donor roll 40 is disposed adjacent to the photosensitive surface 12 of belt 10, and this area where a portion of the donor roll 40 is close to the photosensitive surface 12 is known as the "development zone." The major portion of the donor roll 40 is, however, disposed within a chamber of developer housing 44. Developer housing 44 is preferably provided with a supply of two-component developer material, which, as is known in the art, generally comprises relatively small toner particles, which are used to develop the electrostatic latent image, mixed with a supply of magnetic carrier indicated as 100, which is typically in the form of magnetically-attractable beads. The supply of toner and/or developer into the developer housing 44 can be replenished from an external source (not shown), for example, by means of augers such as 80, which also serve to maintain a desirable even distribution of carrier 100 within the developer.

Although the donor roll 40 is shown in the illustrated embodiment as a rigid cylinder, it is also conceivable that the donor roll 40 could be in the form of a flexible belt entrained around one or more rollers to provide a desired shape. For the illustrated embodiment wherein the donor roll 40 is a relatively rigid cylinder, disposed within the donor roll 40 is a stationary "magnetic structure" 110. The magnetic structure 110 is designed to remain in one position while the donor roll rotates around it. The magnetic structure 110 includes any number of magnetic members as necessary, and these magnetic members may be in the form of discrete metal magnets, or areas of specific magnetic polarity within a continuous structure, such as in a "plastic magnet." Conceivably, the magnetic structure 110 may comprise electromagnets as well. The purpose of the magnetic structure 110 within donor roll 40 is to guide the attraction of the magnetic carrier 100 from the developer supply and cause the magnetic carrier 100 to magnetically adhere to the surface of the donor roll 40 as a given portion of the surface of donor roll 40 is advanced, with motion of donor roll 40, towards the development zone. As is well-known in the art of xerography, two-component developer generally functions as follows: the carrier particles, or beads 100, attracted by the magnets within magnetic structure 110, form filaments of a "magnetic brush", particularly around the poles defined in the magnetic structure, much in the manner of iron filings. Adhering triboelectrically to the carrier beads 100 are any number of toner particles. The magnetic brush of carrier beads thus serves to convey the toner particles to the development zone. In a typical two-component contact developing system, the magnetic brush with toner particles thereon is brought into direct contact with the surface 12 of the photoreceptor belt 10, to develop the latent image thereon. However, in the system of the present invention, instead of having a direct physical contact in the development zone, the magnetic carrier beads 100 serve only to convey the toner particles generally to the development zone and are not intended to contact the photoreceptor. In the development zone, an "powder cloud" is created to separate toner particles from the carrier beads, and cause the toner particles to attach to the latent image.

In order to create the powder cloud of toner particles for developing the latent image on the photoreceptor belt 10, donor roll 40 is provided with a set of longitudinally-disposed electrodes, such as 42 and 43, disposed around the circumference thereof. The general concept of using an electroded donor roll to create such a powder cloud is described in U.S. Pat. No. b 5,172,170, incorporated by reference herein. In brief, as donor roll 40 rotates, a succession of longitudinally-disposed electrodes move into and out of the development zone, and those electrodes generally within the development zone are actuated by the temporary AC biasing of these electrodes, such as by a commutator. The actuation of these electrodes causes electric fields to be created on the surface of the donor roll, and these electric fields create the toner cloud. It is intended that the powder cloud of toner be of such a height that a substantial proportion of the toner particles in the cloud are brought into contact generally with the surface 12 of photoreceptor belt 10. These loose toner particles in the powder cloud will, if they happen to contact an electrostatically-charged portion of the photoreceptor belt 10, adhere to the surface to develop the latent image.

According to the preferred embodiment of the present invention, there are provided along the circumference of the donor roll 40 two interdigitated sets of electrodes, shown respectively as 42 and 43. As can be seen in FIG. 1, electrodes of each type 42 and 43 alternate around the circumference of the donor roll. The functional difference between the two types of electrodes 42 and 43 is that, while both types of electrodes are AC biased generally within the development zone, the two kinds of electrodes 42 and 43 are biased with substantially opposite-phased alternating current. When the adjacent electrodes along the circumference of the donor roll are biased with out-of-phase alternating current, the desired AC electric fields are created outside the surface of the donor roll 40 (AC electric fields will also be created inside the donor roll as well, but these fields are not essential to the invention).

In order to actuate the electrodes 42, 43 in the development zone with the desired AC bias, a preferred method is to connect all of the electrodes 43 to the AC source 122 through a slip ring and to provide a voltage source and contact, herein generally referred to as a "commutator," to activate electrodes 42 while they are in the development zone. Such a commutator is generally shown in FIG. 1 as circuit 120, which includes a brush 126 AC source 122 is indicated in the Figure as "$AC_S$" to indicate connection to a sleeve associated with donor roll 40. AC bias 123 is indicated as "$AC_E$" to denote connection with electrodes 42. Sources 124 are indicated with the subscript "D" to indicate that they apply to the entire development system.. The circuit 120 includes an AC bias 123, which operatively is connected to the brush 126. The AC bias sources 122 and 123 are out-of-phase to provide an AC electric field outside of donor roll 40.

Figure 2:
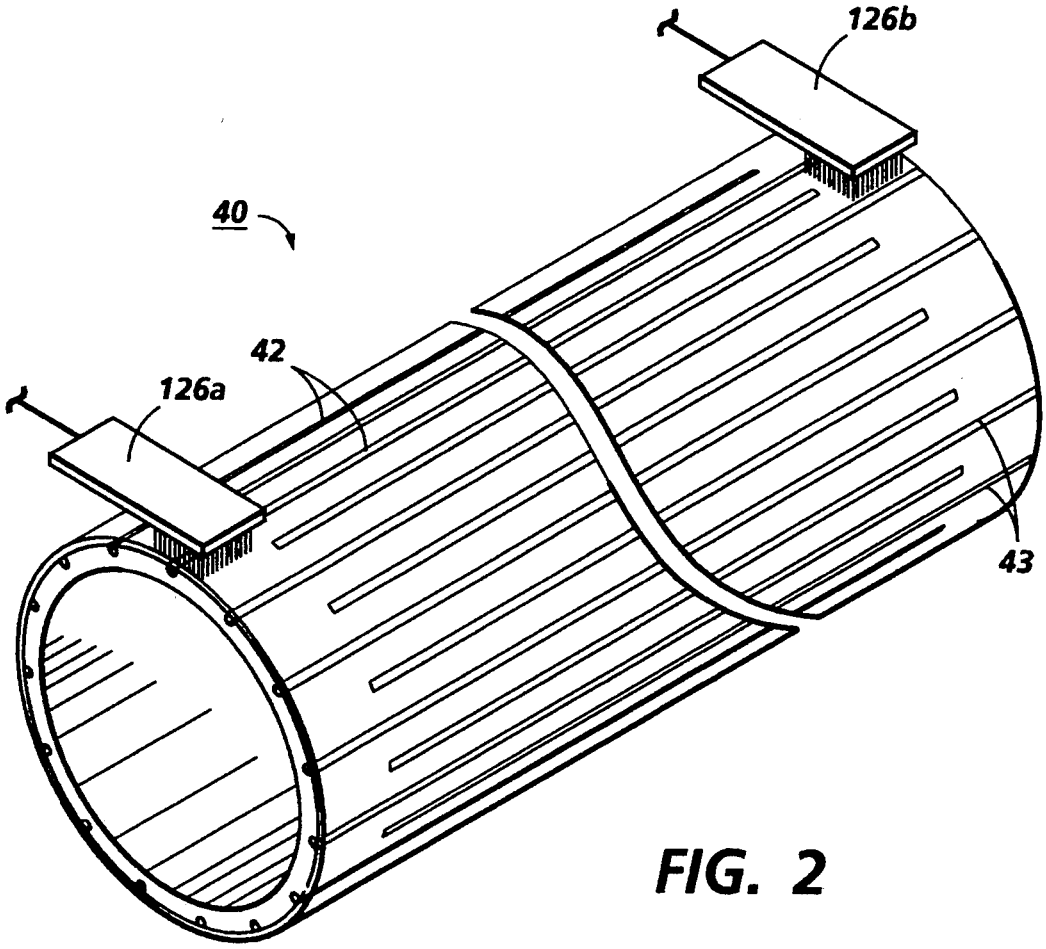
FIG. 2 is a perspective view of a segmented electroded donor roll and wiping commutator brush, in isolation.

Another method for providing opposite-phased bias to every other electrode along the circumference of the donor roll 40 makes use of two separate commutators, preferably in the form of two separate commutator brushes 126. FIG. 2 shows, in isolation, a perspective view of an interdigitated donor roll 40 according to this embodiment of the present invention. Here, it can be seen that the two sets of electrodes 42 and 43 are interdigitated, but that each set of electrodes 42, 43 is "cut short" toward one or the other end of the donor roll 40. It follows that one commutator placed at one end of the donor roll 40 and another commutator placed at the other end of the donor roll 40 will successively contact every other electrode as the donor roll rotates, thus facilitating the alternate-electrode AC biasing for creation of the powder cloud of toner. There is thus also shown in FIG. 2 two separate brushes **126*a* and 126*b*, one brush to contact each set of electrodes 42 and 43** respectively.

In general, it has been found that the most effective type of AC bias for creating a desired powder cloud is to provide low- and high-frequency alternating current to the electrodes simultaneously. In general, a relatively high frequency is useful for initiating the powder cloud creation by AC sources 122 and 123, while varying the amplitude and frequency of the simultaneous lower frequency has been found to be useful in adjusting the height of the powder cloud for the most effective development of a given type of latent image. AS shown in FIG. 1, bias sources 122 and 123 are intended to provide the high-frequency AC to initiate the powder cloud, while the AC bias component of source 124 is adapted to facilitate adjustment of the cloud height relative to the donor roll 40. Commutator 126 is a brush or other contact structure adapted to contact only those electrodes which happen to be in or near the development zone at a given time. As shown in FIG. 1, the brush 126 is thus disposed essentially within the development zone, although off to one side of the path of the belt The brush 126 need only contact one portion of an electrode in order to bias each electrode over the entire length of the donor roll 40.

FIGS. 3A and 3B are detailed views of the development zone of the development unit according to the present invention, illustrating in detail the interaction between the carrier particles 100 and the associated toner particles 102. FIG. 3A shows the forces in the development zone, without the introduction of developer material. As can be seen on either side of the development zone, which is generally the area where the surface of the donor roll 40 is closest to the surface 12 of the photoreceptor, the south and north poles formed in the magnetic structure 110 create a magnetic field shown as dotted lines and indicated as M. Depending on the intensity of the magnetic field, the magnetic field will effectively encompass an area of the surface 12. It is important to note that there is no magnetic pole defined close to the closest point of donor roll 40 to surface 12; it is desired that there be no "pole effects" (i.e., concentration of magnetic flux lines) directly in the development zone. Rather, it is intended that the poles defined in the magnetic structure be disposed so that the pole effects be placed on either side of the development zone, so that, as can be seen, the magnetic flux lines generally in the development zone tend to be substantially parallel to the surface of the donor roll 40. It will be noted that, where the poles are defined, the magnetic flux lines tend to be closer to perpendicular to the surface of the donor roll 40, as shown. However, in the development zone itself, it is preferred that the flux lines be parallel to the surface.

In addition to the magnetic field created in the development zone, there is also created, by the action of the AC-biased electrode wires 42, 43 within donor roll 40, a set of AC fields between adjacent electrodes, which are shown as the double-headed arrows in the Figure. Because of the commutation of AC bias to these electrodes, only the subset of electrodes 42, 43 which are at any one time contacted by a commutator brush 126 will exhibit these AC fields, and these AC fields are preferably limited to the development zone. The electric fields which are evident outside the donor roll 40 which have been shown to create the desired "powder cloud" of toner.

On the donor roll 40, the electrodes 42 and 43 are preferably protected by an outer layer of material through which electric fields are permeable. A number of materials suitable for this purpose are enumerated in co-pending application Ser. No. 08/037,700, filed Mar. 29, 1993, entitled "Development System Coatings."

FIG. 3B shows the physical action of the carrier 100, and the toner particles 102 in the developer material, when they are subjected to the various magnetic and electrical field forces shown in FIG. 3A. From the right-hand side of the illustration, there can be seen a supply of developer having both the toner particles 100 (shown as open circles) and the toner particles 102 (shown as small dots). These two components are, as is known in the art, mixed together so that the toner particles 102 triboelectrically adhere to the carrier particles 100. The layer of developer on the outside of donor roll 40 may be metered, such as by metering blade 45 shown in FIG. 1. The layer of two-component developer material is then advanced to the development zone, where the presence of the poles in magnetic structure 110 cause the carrier 100 to form filaments in the form of chains of particles, much in the manner of iron filings around a magnetic pole. Similarly, filaments are also created around the downstream pole toward the left side of FIG. 3A. In the development zone between the poles, however, where the magnetic flux lines are generally parallel to the outer surface of donor roll 40, the "pile" of the magnetic brush is essentially pushed down and flattened, leaving a generally empty space immediately in the development zone where the donor roll 40 is closest to the surface 12 of the photoreceptor. It is in this development zone between the poles that the electrical fields from the electrode wires 42, 43 in donor roll 40 have the effect of exciting the toner particles 102 which are attached to the carrier beads 100, and the toner particles 102 alone form the desired powder cloud above the flattened portion of the magnetic brush to develop the latent image on the surface 12. It should be noted that, in typical contact two-component development, the pole effects would be desired to be right in the development zone, so that the filaments of the magnetic brush formed by the carrier particles 100 would directly contact the photoreceptor; however, in this invention, it is desired that the magnetic brushes do not contact the photoreceptor, and that the pile of the magnetic brush is fairly flattened in the development zone so that a clean powder cloud of pure toner may be created by the electrodes.

In the preferred embodiment of the present invention, the typical width of the electrodes 42, 43 is 100 μm, and the spacing between the electrodes 42, 43 along the circumference of donor roll 40 is preferably about 150 μm. A typical frequency for generating a toner cloud is approximately 3 kHz, and a simultaneous, relatively lower frequency is also desirable to control the height of the powder cloud.

It will be noted in the Figures that the poles of the magnetic members immediately upstream and downstream of the development zone are shown as having opposite polarities. It has been demonstrated that providing such poles of the same polarity facilitates an effective development system as well. When same-polarity poles are provided, there is created in the development zone a discontinuous pattern of magnetic flux lines associated with like-pole repulsion, as opposed to the continuous lines shown in FIG. 3A; however, this repulsion pattern has been shown to have the desired effect of flattening the pile of the magnetic brush in the development zone, as does the opposite-pole embodiment.

It is further possible, within the scope of certain of the claims below, to provide a development system operable with a developer consisting substantially of magnetically-attractable toner, as opposed to the two-component system described above. Magnetically attractable toner may be attracted to the surface of the donor roll 40 by a magnetic structure and also caused to form a powder cloud by the electrodes described above.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An apparatus for developing a latent image recorded on a surface, including:

a housing defining a chamber storing a supply of magnetically-attractable developer therein, the developer comprising toner:

a moving donor roll spaced from the surface, for transporting developer from the chamber of the housing to a development zone adjacent the surface;

a magnetic structure, disposed within the donor roll, for attracting developer to the donor roll;

a plurality of selectively-actuable electrodes disposed around the circumference of the donor roll, for creating a powder cloud of toner outside the donor roll;

an AC bias source; and a commutating means connecting the AC bias source to at least a subset of the electrodes along a portion of the circumference of the donor roll adjacent the development zone, so that an electrode is biased in a substantially opposite phase to an adjacent electrode along the circumference of the donor roll.

2. An apparatus as in claim 1, wherein the developer comprises magnetic carrier particles.

3. An apparatus as in claim 1, wherein the magnetic structure is stationary relative to the donor roll.

4. An apparatus as in claim 1, wherein the magnetic structure is arranged to provide substantially no pole effects within the development zone.

5. An apparatus as in claim 4, wherein the magnetic structure is arranged to provide pole effects substantially immediately downstream and upstream of the development zone in the direction of motion of the donor roll.

6. An apparatus as in claim 5, wherein the magnetic structure is arranged to provide pole effects of opposite polarity substantially immediately downstream and upstream of the development zone in the direction of motion of the donor roll.

7. An apparatus as in claim 1, wherein the commutating means comprises a first and second commutators, each commutator adapted to actuate every other electrode along a portion of the circumference of the donor roll adjacent the development zone.

8. An apparatus as in claim 7, wherein the first and second commutators are respectively adapted to provide AC biases of substantially opposite phase to the electrodes.

9. An apparatus for developing a latent image recorded on a surface, comprising:

a donor roll spaced from the surface, for transporting developer to a development zone adjacent the surface;

a plurality of selectively-actuable electrodes disposed around the circumference of the donor roll;

an AC bias source; and a commutating means connecting the AC bias source to at least a subset of the electrodes along a portion of the circumference of the donor roll adjacent the development zone, so that an electrode is biased in a substantially opposite phase to an adjacent electrode along the circumference of the donor roll.

10. An apparatus as in claim 9, wherein the commutating means comprises a first and a second commutator; each commutator adapted to actuate every other electrode along a portion of the circumference of the donor roll adjacent the development zone.

* * * * *